United States Patent [19]

Burnthall

[11] Patent Number: 4,462,130

[45] Date of Patent: Jul. 31, 1984

[54] PROCESS FOR TREATING TEXTILE FIBERS

[75] Inventor: Edward V. Burnthall, Lyman, S.C.

[73] Assignee: Beu-Tex Corporation, Morgantown, N.C.

[21] Appl. No.: 390,201

[22] Filed: Jun. 21, 1982

[51] Int. Cl.[3] ..... D06B 3/02; D06B 21/00

[52] U.S. Cl. ..... 8/149.1; 8/156; 68/5 D; 68/9

[58] Field of Search ..... 68/5 D, 5 E, 15, 19.1, 68/9; 8/149.1, 149.2, 156, 149.3

[56] References Cited

U.S. PATENT DOCUMENTS

| | | | |
|---|---|---|---|
| 2,552,078 | 5/1951 | Williams | 68/15 |
| 3,056,275 | 10/1962 | Williams | 68/15 |
| 3,367,150 | 2/1968 | Smith et al. | 68/15 |
| 3,660,014 | 5/1972 | Ohya | 8/149.1 |
| 3,770,374 | 11/1973 | Fleissner | 8/149.3 |
| 4,104,019 | 8/1978 | Smith | 8/444 |

*Primary Examiner*—Philip R. Coe
*Attorney, Agent, or Firm*—Luke J. Wilburn, Jr.; Wellington M. Manning, Jr.

[57] ABSTRACT

A process for continuously dyeing or chemically treating textile staple length fibers having thermoplastic properties while conveying the fibers in a desired path of travel wherein the fibers are impregnated by passage through a liquid dye or chemical applicator and subsequently compressed and advanced in compressed form into and through a confined heating zone for reaction of the dye or chemical with the fibers, and wherein the fibers are preheated prior to their compaction at a temperature below their second order transition point but above the reaction temperature of the dye or other chemical applied thereto to compact and reduce the bulk of the same before their compression and delivery into the confined heating zone.

5 Claims, 2 Drawing Figures

PROCESS FOR TREATING TEXTILE FIBERS

The present invention relates to an improved process for treating textile fibers and, more particularly, to an improved process for the continuous uniform dyeing or other chemical treatment of synthetic fibrous materials having thermoplastic characteristics.

BACKGROUND OF THE INVENTION

It is known to continuously dye textile fibrous materials, such as loose staple fibers, by impregnating the fibers with a liquid dye or other chemical, and thereafter continuously passing the fibers through a confined high frequency energy heating zone to react and fix the dye or other chemical on the fibers. As used herein, the terms "liquid dye or other chemical" means any dye or other chemical which is in a liquid medium form when applied to the textile fibrous materials.

U.S. Pat. No. 4,104,019 discloses process and apparatus for the fixation of dyes or other chemicals onto textile fibers by continuously passing the same through a confined radio frequency energy heating tube. The fibers are compressed and compacted in the confined heating tube to form a partially self-sealing pressure chamber whereby generation of steam from the wetted fibers accelerates the reaction of the dye on the fibers. A copending commonly assigned Beucus U.S. patent application Ser. No. 390,207 discloses method and apparatus for continuously dyeing textile fibrous materials using radio frequency energy to react the dye on the fibers, as referred to in U.S. Pat. No. 4,104,019. Said copending application relates to an improvement wherein the loose fibrous materials may be dyed at a greater rate of production by intermittent batch-wise delivery to a compression chamber and ram assembly which introduces the dye-wetted fibers under compression into the confined heating tube.

In such continuous treatment of textile fibrous materials by compressed passage through a confined radio-frequency energy heating tube, it has been found that loose masses of certain synthetic staple fibers having thermoplastic properties, in particular acrylic fibers, are quite bulky and have such a high loft and volume that they are difficult to effectively compact and compress at a high rate of production. In particular, even with the intermittent delivery of acrylic fibers into a compression chamber as described in the aforesaid copending U.S. patent application, the apparatus can effectively handle only up to about 500 pounds of dry weight acrylic fiber per hour. For greater economy of production, it is of course desirable to further increase the capacity of the apparatus for handling and dyeing or otherwise chemically treating textile fibrous materials.

It has also been found that in the continuous high speed dyeing of loose textile fibers, in particular, synthetic fibers utilizing the high frequency heating apparatus described in U.S. Pat. No. 4,104,019, problems can also occur in obtaining uniform distribution and fixation of the dye color in the compressed fibrous mass. Such is believed due to non-uniform packing of the fibrous mass in the confined heating tube which produces density variations in the mass. In particular, if the packing density varies across or along the length of the mass of fibers in the tube, the concentration of the liquid phase which constitutes the lossy material in the heating tube will also vary, causing corresponding temperature variations in the mass being heated by radio frequency energy. Such temperature variations accordingly produce differential dye reactivity and color shade variations in the fibers.

BRIEF OBJECTS OF THE INVENTION

It is therefore an object of the present invention to provide an improved process for the continuous dyeing or other chemical treatment of textile fibrous materials having thermoplastic characteristics, wherein the materials may be effectively treated more unformly and rapidly with use of high frequency energy than heretofore obtained.

It is another object to provide an improved process for the continuous dyeing of textile fibrous materials, in particular acrylic fibers, utilizing radio frequency energy to react the dye with the fibrous materials while in compressed confined condition.

It is a further object to provide an improved process for the continuous dyeing of textile fibrous materials with fixation of the dyes on the materials while the fibers are transported through a confined heating zone under pressure, whereby more uniform packing of the fibers contributes to uniform and consistent dye shade development of the same during dye fixation.

It is a further object of the present invention to provide an improved process for continuous dyeing or other chemical treatment of loose fibrous materials, with high-frequency heat energy fixation of the dye on the fibers while under compression, and wherein the compressed fibers may be more uniformly compressed and packed into a confined heating zone, permitting higher pressure build-up in the zone of vaporized liquids and higher temperatures with lower energy input during the heat treating stage.

BRIEF DESCRIPTION OF THE DRAWINGS

The above as well as other objects of the present invention will become more apparent, and the invention will be better understood, from the following detailed description of preferred embodiments thereof, when taken together with the accompanying drawings, in which.

BRIEF SUMMARY OF THE INVENTION

The present invention is directed to an improved process for continuous treatment of loose textile fibrous materials having thermoplastic properties wherein the fibers are impregnated with a liquid dye or other chemical to a desired wet pick-up, and thereafter transported in continuous mass or bulk form to be heated in a confined tube by the use of radio frequency energy, while maintaining the fibers under a desired degree of compression during their passage through the tube. More particularly, the rate of treatment of such fibrous materials on such equipment can be greatly increased by preheating the bulk fibrous materials prior to their physical compression and forced passage through the heating tube. The preheating of the fibrous materials, preferably with preliminary pressure applied temporarily thereto, causes a pre-compaction and reduction in overall bulk of the fibers, whereby they can be delivered at a greater rate through the heating tube, and whereby the density of the mass of compressed fibers passing through the tube may be more uniformly controlled.

Preheating of the thermoplastic fibers is carried out at a temperature below the second order transition point of the fiber, and below the reaction temperature at which dye or other chemical applied to the fibers would begin to fix or react with the fibers. By pre-compaction of the fibrous materials before dye fixation, the fibrous materials may be compressed more compactly and uniformly through the confined heating tube for reaction to ensure more uniform treatment of the same.

DETAILED DESCRIPTION OF PREFERRED EMBODIMENTS

Figure 1:
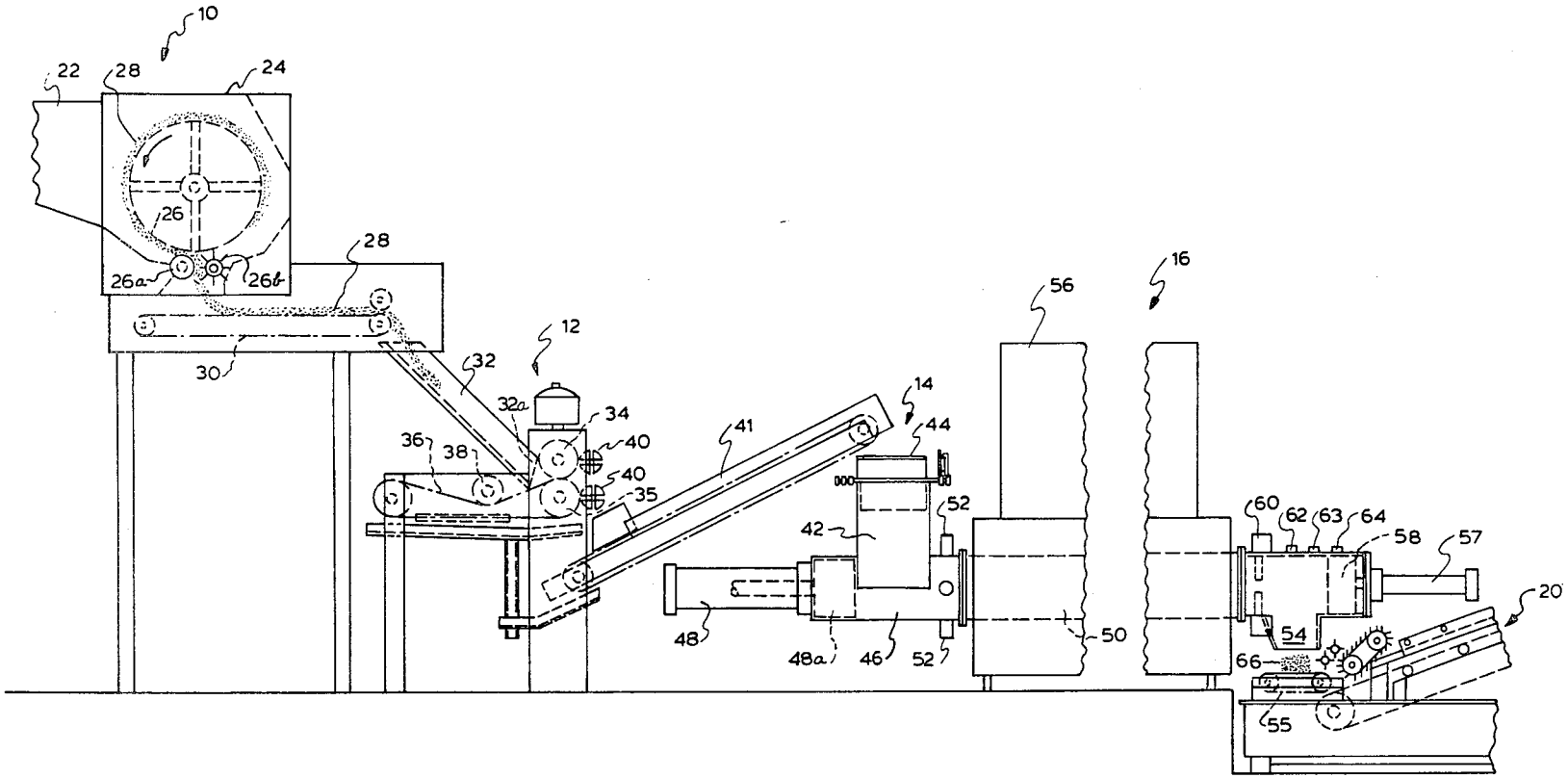
FIG. 1 is a schematic side elevation view illustrating diagrammatically major component parts of a range for the continuous dyeing or other chemical treatment of textile fibrous materials in accordance with the process of the present invention.

The process of the present invention may be effectively carried out on a continuous textile fibrous material dyeing range, the major component parts of which are schematically illustrated in FIG. 1 and are described in detail in aforesaid copending Beucus U.S. patent application Ser. No. 390,207, filed June 21, 1982. The disclosure of said application is included herein by reference.

Referring more specifically to the drawings, FIG. 1 shows improved apparatus of the present invention for the continuous dyeing or otherwise chemically treating textile fibrous material. Basically, the continuous treatment range includes a fibrous material supply section 10, a dye or chemical applicator section 12, a fibrous material compression section 14, a high frequency energy heating tube section 16, and a washing section 20.

Textile fibrous material, typically in the form of loose staple length fibers, is pneumatically conveyed by way of a delivery tube 22 from a suitable supply source, such as conventional textile opening and weigh pan blending equipment (not shown), into a fiber condenser unit 24 containing a rotating filter drum 26. The interior of the drum is connected to a vacuum source, such as a motorized fan (not shown), such that a condensed fibrous web 28 accumulates on the filter drum outer surface. The drum continuously rotates in the direction indicated by the arrow to discharge a cohesive web of fibers by way of a pressure roller **26*a* and bladed stripping roller 26*b*, onto a moving belt conveyor 30 which continuously delivers the web to an inclined chute conveyor 32. Details of the fiber condenser unit 24** and its cooperative use in the continuous treatment range form the subject matter of a different invention contained in a commonly assigned copending U.S. patent application Ser. No. 390,202, filed June 21, 1982.

The lower outlet end **32*a* of chute 32 is disposed immediately adjacent the nip of a pair of mangle rollers 34, 35 of a padding unit of the liquid dye or chemical applicator section 12. The amount of fiber supplied to the treating range is controlled by varying the rate of delivery of fiber to condenser unit 14** of the range, and suitable motor means, e.g., DC drive motors, (not shown) are operatively connected in conventional manner to positively drive the various conveyors and rollers for delivery of fibers through the treating range.

The padding unit of section 12, details of which are known in the art, includes a driven endless belt 36, the central portion of the upper reach of which is downwardly deflected by rollers 38 to form a depression, or well, for retaining a treating liquid, such as a liquid dye composition. Belt 36 is entrained about the lower mangle roller 35 and moves to convey and transfer liquid dye into the fiber web as it is delivered from the end of chute 32 into the nip of the mangle rollers. Pressure is applied in conventional manner (not shown) to the mangle rollers to express liquid dye from the fibers and obtain a desired amount of wet dye pickup in the fibers. The dye-impregnated fibers are removed from the surface of the mangle rollers by rubber-bladed scraper rollers 40 and are deposited in broken apart, smaller masses of fiber onto a continuously moving conveyor 41.

The wetted loose fibrous material containing a desired amount of dye liquid is continuously gravitationally delivered by conveyor 41 into the upper end of a fiber-receiving hopper 42 of fiber compression section 16. The upper portion of hopper 42 is provided with a pair of fiber collecting plates 44 which are pivotally mounted in overlapping relation for collecting and periodically depositing accumulated fibers into a lower compression chamber 46 of hopper 42. The compression head **48*a* of a double-acting hydraulic ram assembly 48 moves through the compression chamber in a generally horizontal direction to compress the fibrous material received in the chamber and push the same into the inlet of an elongate confined radio-frequency energy heating tube 50. A plurality of hydraulic piston-actuated, fiber-retaining pins 52 are arcuately disposed about the inlet of heating tube 50 and are arranged and operated to move radially into the fiber passageway to retain compressed fiber in the heating tube 50 against backward movement into the compression chamber 46 each time ram head 48*a*** is retracted for the beginning of another compression stroke.

Details of the operation of the fiber-collecting plates in the upper end of the hopper, and their movement to deposit fibers collected thereon into the compression chamber in response to the absence of the ram compression head therein from the subject matter of a different invention contained in a commonly assigned copending Beucus U.S. patent application Ser. No. 390,207, filed June 21, 1982. The disclosure of said application is incorporated herein by reference.

The fibers passing through the tube are heated by conventional RF energy generating equipment, which includes an H.T. transformer, rectifier, tube oscillator, and tank circuit adjustable to give a radio frequency of 27.12 megahertz. The generating equipment, details of which are known in the art and are not shown in FIG. 1, are located in an insulated protective housing 56. The RF energy imparted to the dye-impregnated, compacted fibers in tube 50 raises the temperature in the fibrous material to a desired degree to set and/or otherwise fix the dye on the fibers, as by ionic bonding of the dye molecules to the fiber molecules.

As best seen in FIG. 1, the exit end of the heating tube 50 has a downwardly disposed fiber outlet 54 for discharging fibers onto a moving conveyor 55. Disposed in the exit end portion of heating tube 50 to control periodic discharge of compressed fiber mass sections from the tube outlet is a pneumatic piston 57 with pressure head 58 and a plurality of pneumatic piston-actuated, fiber-retaining pins 60. Pistons of the pressure head 58 and retaining pins 60 are of the double-acting type and connected through conventional control valves, pressure regulator, and supply lines to a source of pressurized air (not shown). The exit piston pressure head 58 is arranged to move horizontally through the end portion of the heating tube over outlet 54, and located in its path of travel are three switches 62, 63, 64 which are connected to actuate the pneumatic control valves and supply pressurized air to the exit piston and pin pistons in the following sequence.

Compressed fiber mass sections 66 are periodically discharged from the heating tube in the following cycle. When the exit piston pressure head 58 is fully extended into the exit end of the heating tube to close the tube passageway and contact switch 62, pressure regulated air is supplied to the exit piston 57 to maintain a constant counter pressure of the pressure head against the compressed fibers in the tube. Pressurized air is also supplied to the pistons of pins 60 to fully retract the pins from the heating tube passageway. As fiber pressure builds in the heating tube due to the compressing action of the main compression ram assembly 48, the exit piston pressure head 58 is pushed outwardly of the tube by the moving fiber mass, to the right as seen in FIG. 1, until it contacts switch 63. Switch 63 actuates the air control valves to supply pressurized air to the pistons of pins 60 to insert the pins into the heating tube passageway and thereby retain the fibers under compression in the tube upstream of the pin positions. Pressurized air is also supplied to the exit piston 57, after momentary time delay, to move the pressure head 58 quickly further outwardly of the exit end of the heating tube, thereby releasing the section of compacted fibers between the pins and pressure head which falls by gravity through the heating tube outlet 54 and onto the conveyor 55. When the pressure head 58 contacts switch 64, pressurized air is supplied to the exit piston 57 to return the pressure head back to its innermost position to contact switch 62 and close the tube outlet 54. Contact of the pressure head with switch 62 directs compressed air to again retract the fiber-retaining pins 60 from the heating tube passageway and establish a constant counter pressure of the pressure head 58 on the fibers for the beginning of another discharge cycle.

Sections 66 of released fibrous material which gravitationally fall from exit outlet 54 of the tube are conveyed by suitable conveyor sections through washing section 20, after which they are dried and collected in suitable manner (not shown).

It has been found that synthetic fibers having thermoplastic characteristics, such as acrylic and polyester fibers, have such high loft and volume in loose bulk form that it is difficult to process the same on the aforedescribed treating equipment at a high rate of production. In particular, the high loft and bulk of such loose fiber materials passing into the compression chamber of the hopper section of the apparatus of FIG. 1 tends to clog and jam the ram assembly and compression chamber at rates of delivery above a level of about 500–600 pounds of fiber delivery per hour. By means of the process of the present invention, i.e., controlled preheating of the synthetic fiber materials before their mechanical compression and compaction into the heating zone, the mass of fibers delivered to the compression chamber are precompacted and compressed, permitting a greater weight of fibers to be processed through the compression chamber for mechanical compaction in a given time period.

To accomplish these ends, means are provided for controlled preheating of the fibrous materials to relax the fibers and reduce their mass bulk prior to their introduction into fiber compression hopper of the dye range. Preheating of the fibers preferably is accomplished by heating the dye liquid which impregnates the fibers in the dye pad applicator section, followed by pressure application of the nip rollers 34, 35 to express dye liquid therefrom. The fibers also may be preheated by provision of additional heating means located in the path of fiber movement to the hopper compression chamber, either before or after dye application. Such may take the form of infra-red heaters or steaming chambers through which the fibers pass. Preferably, the preheating is accomplished in a wet or high humidity environment to facilitate heat transfer into the fibers and provide lubricity for individual fiber movement in the mass.

Preheating of the fibers must be maintained within a controlled temperature range, specifically at a temperature below their second order, or glass, transition point, and below the temperature at which any dye applied thereto will start to react or strike into the fibers. The preheating preferably should be accompanied or followed by a pressure applied to the preheated fibers to compact their bulk or volume, which correspondingly increases the bulk density of the same. Such increase in bulk or mass density with consequent reduction in loft is believed due to a general heat relaxation of the latent crimp or stresses imposed in the synthetic, thermoplastic fibers during their manufacturing operations. In any event, the preheating of the fibers greatly compacts the bulk and mass of the same without adversely affecting the properties thereof, and as such, the fibers may be introduced at a higher rate of mass delivery, i.e., weight, than the non-preheated fibers.

In addition, pre-heat compression and compaction of the fibers before their mechanical compression and delivery through the heating tube provides for more uniform packing of the fibers during their passage through the heating tube. Due to the nature of high frequency heating of the fibers which relies on lossy materials, i.e., the aqueous medium of the dye, to create and transmit the heat to the fibrous material, the temperature gradient across as well as along the compacted longitudinal mass of the same in the heating tube can be made more uniform. By more uniformly heating the fibers in the heating tube, more uniform dye fixation can be obtained.

The advantages of the process of the present invention may be better appreciated by the following examples illustrating the dyeing of synthetic fibers in loose form with and without preheating of the same before delivery into the compression chamber of the hopper. The examples are by way of illustration and not intended to limit the scope of the present invention.

EXAMPLE 1

Three denier acrylic 1⅛ inch staple length fibers (Acrilan B-16 manufactured by Monsanto Company), were continuously dyed on the dyeing range of FIG. 1 utilizing a cationic aqueous dye composition having the following components by weight:

1% Seragum 5076 by Kemloid Corporation
½% acetic acid
0.72% Astrazon Yellow GRL, Mobay Chemical
0.45% Sevron Red CDL, Crompton & Knowles
0.37% Sevron Blue 5GMF, Crompton & Knowles The dye formulation, which has an afghan brown color, was continuously applied to the fibrous batt at the dye applicator section. Pressure on the mangle rollers was controlled to provide a wet pick up of the liquid dye composition on the fibers of about 100 to 125 percent. Masses of the fibers were directed to and gravitationally deposited into the compression chamber of the fiber receiving hopper where they were compressed by the compression ram through the confined heating tube which is maintained at an energy level to provide a temperature of around 230° F. to fix and react the dye on the compressed fibers passing therethrough. Speed of delivery of the dye impregnated fibers to the hopper was increased during the dyeing operation up to a speed of approximately 560 pounds fiber per hour (as measured by dry weight of the fibers entering the dye pad applicator), above which point the fibrous material began to clog and jam the ram assembly preventing introduction of further fibrous materials into the heating tube. It was necessary to stop the operation of the dyeing equipment to reestablish continuous dyeing operation at a rate of fiber throughput of no more than around 500 pounds dry weight fiber per hour.

EXAMPLE 2

Acrylic fibrous materials as identified in Example 1 were continuously impregnated with the dye composition of Example 1 and delivered to the fiber-receiving hopper of the dye range; except that the temperature of the dye liquid was raised to 160° F.

The dye impregnated fibrous materials were compacted due to the heat and pressure before delivery to the hopper compression chamber. Speed of delivery of the fibers to the hopper compression chamber was increased up to a rate of 1,000 pounds per hour (dry weight) with no problems in handling of the fibers at the hopper compression chamber.

Figure 2:
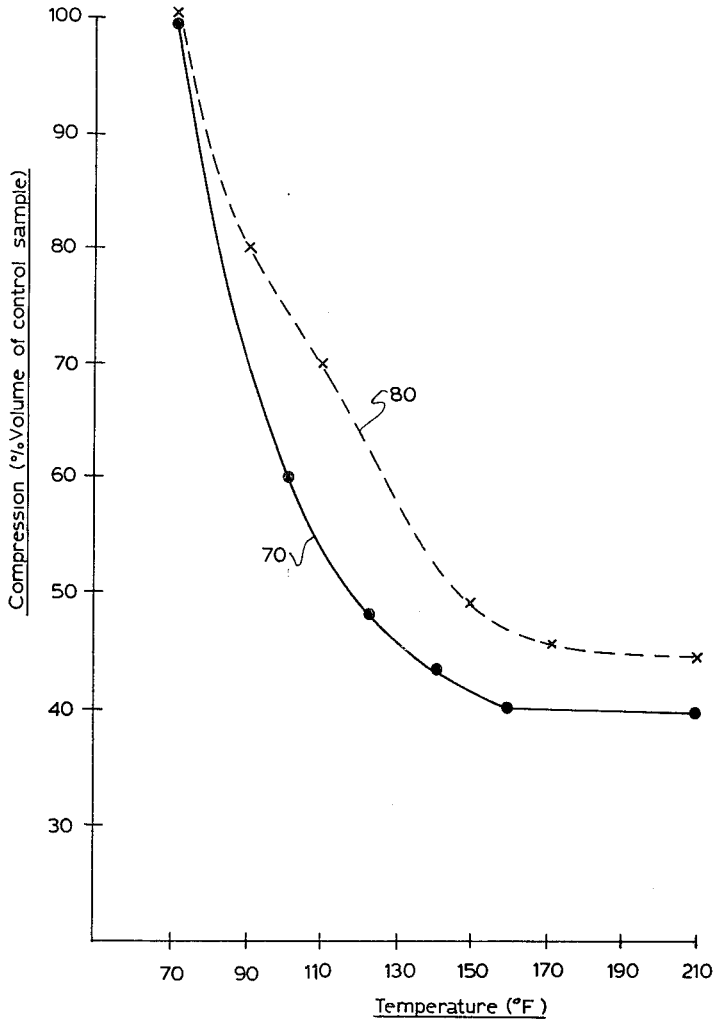
FIG. 2 is a graph illustrating the compaction occurring upon heating of acrylic staple fibers and polyester fibers in generally bulk form.

FIG. 2 illustrates in graphic form the effect of preheating of synthetic staple fibers containing thermoplastic components to reduce their loft and/or bulk in loose mass form. FIG. 2 graphically illustrates by the lines 70 and 80, for three denier acrylic 1⅛ inch staple fiber and three denier polyester 1½ inch staple fiber, respectively, the effect of temperature of the fibers on their compression, expressed as a percent of the volume of corresponding fiber type wet with cold tap water at room temperature under equivalent pressure, as control. Multiple sample strips of sliver of the two fiber types having the same weight and length were wet out with water at different temperatures and passed through a nip roller apparatus to give 100% residual water content. The wetted slivers were each placed in a 500 CC graduated cylinder and compressed, utilizing a 100 gram weight for the acrylic fiber and a 500 gram weight for polyester fiber. The amount of compression at various temperatures was compared with correspondingly compressed wet out, room temperature samples of the respective fibers.

As can be observed from the graph of FIG. 2, as the temperature of samples of the acrylic fiber is raised, they increasingly compact to reach a maximum of approximately 40 percent of their original wet bulk at room temperature when heated to a temperature of approximately 160° F. Correspondingly, polyester staple fiber compacts to a point of approximately 44 percent of its bulk at a temperature of approximately 160° F. Thus, it can be seen that fibers containing thermoplastic properties, as illustrated by the acrylic and polyester staple fiber tests represented in the graph of FIG. 2, will compact or compress under conditions of temperature with optimum compression being obtained in a temperature pretreatment range of around 160° F. for both types.

That which is claimed is:

1. In a process for continuously dyeing or chemically treating textile staple length fibers having thermoplastic properties while conveying the fibers in a desired path of travel and including the steps of impregnating the moving fibers with a desired amount of liquid dye or other chemical, and compressing and advancing the compressed impregnated fibers into and through a confined heating zone for reaction of the dye or chemical therewith; the improvement comprising the step of preheating the fibers to a temperature below their second order transition point and below the reaction temperature of the dye or other chemical applied to the fibers to compact and reduce the bulk of the fibers before their compression and delivery into said confined heating zone.

2. A process as defined in claim 1 wherein the fibers are impregnated with a liquid dye and are preheated to a temperature of about 160° F.

3. A process as defined in claim 1 wherein the fibrous material is gravitationally delivered to the compression zone in the form of a loose fibrous mass, and wherein the fibers are preheated to increase the density of the fibrous mass prior to its delivery into the compression zone.

4. A process as defined in claim 1 wherein the loose fibrous materials are impregnated with a desired amount of dye by applying dye to the materials to wet the same and thereafter applying a pressure to the materials to express the dye therefrom to a desired pick-up of dye in the materials, and wherein the step of preheating the fibrous materials occurs prior to applying said pressure to the materials to express dye therefrom.

5. A process as defined in claim 4 wherein the fibrous materials are preheated to compact and reduce the bulk of the same by steam treatment.

* * * * *